US011006737B2

(12) United States Patent
Steele

(10) Patent No.: US 11,006,737 B2
(45) Date of Patent: May 18, 2021

(54) RUNNING PACK

(71) Applicant: Stuart Steele, West Milford, NJ (US)

(72) Inventor: Stuart Steele, West Milford, NJ (US)

( * ) Notice: Subject to any disclaimer, the term of this patent is extended or adjusted under 35 U.S.C. 154(b) by 0 days.

(21) Appl. No.: 16/866,981

(22) Filed: May 5, 2020

(65) Prior Publication Data

US 2021/0085062 A1 Mar. 25, 2021

Related U.S. Application Data

(60) Provisional application No. 62/904,303, filed on Sep. 23, 2019.

(51) Int. Cl.
*A45F 3/16* (2006.01)
*A45F 3/04* (2006.01)

(52) U.S. Cl.
CPC ..... *A45F 3/16* (2013.01); *A45F 3/04* (2013.01); *A45F 2003/166* (2013.01)

(58) Field of Classification Search
CPC ..... A45F 3/16; A45F 2003/166; A45F 3/047
USPC ..... 224/148.1–148.7, 926, 637, 641, 250
See application file for complete search history.

(56) References Cited

U.S. PATENT DOCUMENTS

| | | | | |
|---|---|---|---|---|
| 1,530,342 | A * | 3/1925 | Barber | A45F 5/02 224/665 |
| 3,893,607 | A * | 7/1975 | Jones | B65D 71/0007 206/576 |
| 4,461,411 | A * | 7/1984 | Harrow | A45F 5/00 224/258 |
| 4,634,031 | A | 1/1987 | Frankhouse | |
| 4,700,761 | A | 10/1987 | Gladding | |
| 5,890,809 | A * | 4/1999 | Nelson | A45C 3/00 224/148.5 |
| 5,954,250 | A * | 9/1999 | Hall | A62B 9/04 224/262 |
| 8,225,973 | B1 | 7/2012 | Bellinson | |
| 10,327,535 | B2 | 6/2019 | Steele | |
| 2007/0152007 | A1 | 7/2007 | Kauss et al. | |
| 2008/0067202 | A1* | 3/2008 | Silva | A41D 13/01 224/148.2 |

(Continued)

FOREIGN PATENT DOCUMENTS

| | | |
|---|---|---|
| CN | 204245384 U | 4/2015 |
| CN | 204427030 U | 7/2015 |

OTHER PUBLICATIONS

Kings Camo Daylite Hydration Waist Pack; http://www.sierratradingpost.com/kings-daylite-hydration-waist-pack~p~125nj/ accessed Jul. 12, 2016.

(Continued)

*Primary Examiner* — Scott T McNurlen
(74) *Attorney, Agent, or Firm* — Myers Wolin, LLC

(57) ABSTRACT

A running survival pack system that may be used for hiking, trail-running, backpacking, biking, hunting, fishing, or other indoor or outdoor activities is disclosed. The running survival pack has a plurality of storage chambers that are worn over the user's shoulders and secured to the user with a plurality of attachments. Each chamber has an access that allows the user to store and remove items. On the back of the running survival pack, there is a hydration sack that may hold a fluid container. The fluid container may have an opening that allows for a tube to be connected to it. The user may drink the contents of the fluid container via the tube.

14 Claims, 5 Drawing Sheets

(56) References Cited

U.S. PATENT DOCUMENTS

| | | | | |
|---|---|---|---|---|
| 2008/0217367 | A1 | 9/2008 | Lillie | |
| 2014/0191002 | A1 | 7/2014 | Garcia Morales | |
| 2014/0346209 | A1 | 11/2014 | Amend et al. | |
| 2015/0366332 | A1 | 12/2015 | Marji | |
| 2016/0128394 | A1 | 5/2016 | Kohrman | |
| 2017/0055683 | A1* | 3/2017 | Willows | A45F 3/14 |
| 2017/0156478 | A1* | 6/2017 | Steele | A45F 3/16 |

OTHER PUBLICATIONS

NRS PFD Hydration Pack | CKS; http://www.coloradokayak.com/NRSPFDHydrationPack; Accessed Jul. 12, 2016.

Platatac Echo Hydration Pack MKII+Straps; http://www.platatac.com/platatacechohydrationpackmkiistraps.html; Accessed Jul. 12, 2016.

Zippered Yoga Mat Carrier Mat Bag; https://www.matsmatsmats.com/yoga/yogazippertote.html; Accessed Jul. 12, 2016.

* cited by examiner

RUNNING PACK

CROSS-REFERENCE TO RELATED APPLICATION

This application claims the benefit of U.S. Provisional Application No. 62/904,303, filed on Sep. 23, 2019, the contents of which are incorporated by reference herein.

FIELD OF THE INVENTION

The present invention relates generally to outdoor sport packs. More specifically, the invention relates to running packs for carrying items for running in a bio-mechanically efficient manner. While the discussion relates to running packs, the invention may be utilized in any context in which a backpack or hydration pack would be useful.

BACKGROUND

Running requires long, vigorous runs, usually on trails, footpaths, hills, mountains and valleys. This running of long distances requires a lot of sustained energy. Consequently, runners typically try to improve their efficiency by implementing techniques to travel faster and farther, conserve energy and reduce fatigue. Runners use techniques that result in a reduction and elimination of resistance to motion, an increase in stride to increase speed and endurance, an improvement in breathing for increased speed and alertness, and a reduction and elimination of energy wasting motion. Runners further improve their performance by reducing and eliminating resistance to efficient fluid motion in their clothing, footwear, packs and gear that resist efficient fluid motion or generate discomfort.

Weight reduction is another method runners use to increase their performance. To carry their affairs, runners typically use vest-packs and backpacks. Typically, a backpack is a storage container located on the back of an individual supported by shoulder straps. Water is typically the heaviest item hikers have to carry. Hikers often use hydration packs to carry water. A hydration pack is a fluid-carrying device used to carry water, a sports drink, coffee, or another consumable fluid during walking, backpacking, bicycling, hiking, trail-running, jogging, or other athletic activities. A hydration pack typically includes a bladder or other fluid reservoir that is attached to the associated person by open pockets, stored within or outside the backpack or attached by other means. A fluid delivery tube can be utilized extending from the fluid reservoir, such as a fluid bladder, fluid container, or so forth, and at the distal end includes a bite valve or other mechanism to selectively allow the person to drink. In some hydration packs, the bite valve or other delivery mechanism is readily accessed while performing rigorous activity. A typical hydration pack employs an elongated fluid reservoir positioned in a backpack substantially centered, on the spine of the back, with the fluid delivery tube connected at the bottom of the fluid reservoir. Such an arrangement promotes efficient and complete delivery of all fluid in the backpack, and also keeps weight centered on the spinal column. However, existing hydration packs are problematic in that they have a tendency to shift about during rigorous activity, which can tend to unbalance the wearer or in extreme cases cause a fall or other accident. In addition, many hydration packs do not allow for the efficient storage of other items that a hiker may wish to carry. Furthermore, many hydration packs stored within a backpack make it difficult to refill the hydration pack.

Further, existing running packs in which storage is provided in the straps tend to result in bulky straps located at inconvenient locations on a user's chest and shoulders such that loads contained therein are unbalanced and not centered on a user's body. Fluids located on or in shoulder straps create an unbalanced load when drinking from one side or the other side but not drinking from both. This is significant, because fluid is typically the heaviest item in such packs. Further, such packs tend to be long for carrying large capacity fluid packs, and space for sufficient gear, resulting in fluid packs extending to the hips of a wearer. Such packs are deep and wide causing side to side thrusting energy waste. Backpacks having a length down to a persons hips or longer eliminates their natural pace speed. Hip belts unless tightened below the navel limit natural breathing performance. Carrying a load of less than twenty pounds doesn't require a hip belt to transfer a portion of the load to the hips. Hip belts may include thrusted energy wasting side storage. Eliminating the hip belt for under 20 pound loads permits proper breathing and side storage if provided wastes energy due to side to side thrusting. Shoulder straps located too close to shoulder ends will cause lifting of the backpack wasting energy. Backpacks occupy the majority of a persons' rear torso surface area generating perspiration and related energy consuming fatigue during the major seasonal period for outdoor sports.

Vest-packs utilize a water bladder in the rear or water bottles of low capacity located in the front of the vest-pack. Bladders reduce the available storage capacity, are heavy compared to a typical water bottle, require hygienic maintenance, add a distinct taste to the fluid stored and are wide causing side to side thrusting of the vest-pack. Water bottles stored in front of a vest-pack normally have limited capacity and cause side to side thrusting wasting energy. Vest packs are usually long in front into the abdominal area that can cause reduced breathing when tied too tight and are dangerous having two release clips limiting quick removal of the vest-pack in an emergency. Rear storage of a vest-pack is usually small but occupies sufficient surface area to cause perspiration and related energy consuming fatigue during the major seasonal period for outdoor sports.

Therefore, there is a need for a more efficient, lighter, and wearable running pack for carrying fluid and items for trail-running, hiking, and biking, which eliminates the many bio-mechanical inefficiencies discussed herein.

SUMMARY

In some embodiments, a running pack is provided, the running pack comprising a plurality of elongated storage chambers, each chamber having a first end and a second end. The pack further comprises a hydration sack for retaining a fluid, the hydration sack having a top end and a bottom end and a releasable connector for connecting the first end of a first elongated storage chamber to the first end of a second elongated storage chamber of the plurality of elongated storage chambers. A tensioning strap independent of the releasable connector is provided for connecting the first end of the first elongated storage chamber to the bottom of the hydration sack and to first end of the second elongated storage chamber.

The second end of the first elongated storage chamber is connected to the second end of the second elongated storage chamber and the top end of the hydration sack.

In some embodiments, when the running pack is worn by a user, the first ends of each of the first and second elongated storage chambers are located at the user's chest and each of the first and second elongated storage chambers extend over the user's shoulders, while the hydration sack is located at the user's back.

In some embodiments, the hydration sack further comprises a seam extending from the bottom end of the hydration sack to the top end of the hydration sack and the second end of the first and second elongated storage chambers connect to the seam at the top end of the hydration sack and the tensioning strap is connected to the seam at the bottom end of the hydration sack. The seam may be reinforced and thereby thicker or stiffer than webbing used elsewhere in the hydration sack.

In some embodiments, the hydration sack has a plurality of fixation points adjacent the top end, and the second end of the first elongated storage chamber and the second end of the second elongated storage chamber are selectively fixed to one of the plurality of fixation points. The plurality of fixation points may be arranged vertically along a length of the hydration sack, and the hiking pack may then be in a first size configuration when the first and second elongated storage chambers are connected to a first fixation point and in a second size configuration when the first and second elongated storage chambers are connected to a second fixation point.

In some such embodiments, the first size is configured for locating a first size of fluid container within the hydration sack and the second size is for locating a second size of fluid container within the hydration sack.

In some embodiments, each of the first and second elongated storage chambers have interior space between their respective first ends and second ends.

In some embodiments, the running pack further comprises a stabilizing strap extending from the tensioning strap at two locations and encircling the hydration sack, wherein the stabilizing strap has a length longer than a length of the tensioning strap between the two locations.

In some embodiments, a stabilizing strap may extend from the tensioning strap at two locations and be secured to sides of the hydration sack and to the tensioning strap.

The hydration sack may comprise an opening adjacent the top end and, optionally, at the bottom end. The hydration sack may hold a fluid container, such as a fluid bladder, and the fluid container may be attached to a fluid tube. In such an embodiment, the fluid tube may be secured to one of the elongated storage chambers by a securing mechanism.

DETAILED DESCRIPTION OF THE PREFERRED EMBODIMENTS

Figure 1:
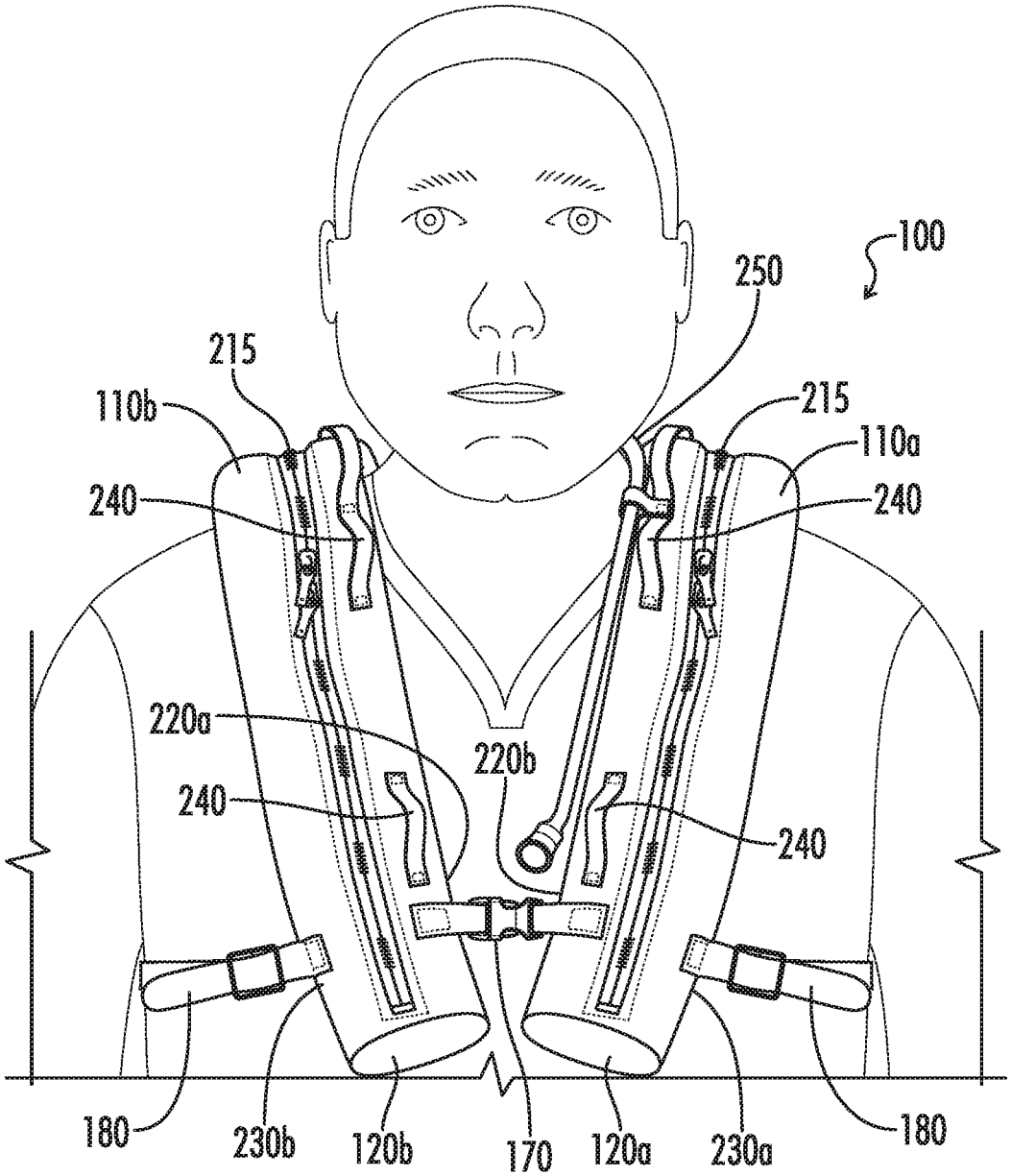
FIG. 1 is a front view of a running pack work by a user in accordance with the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
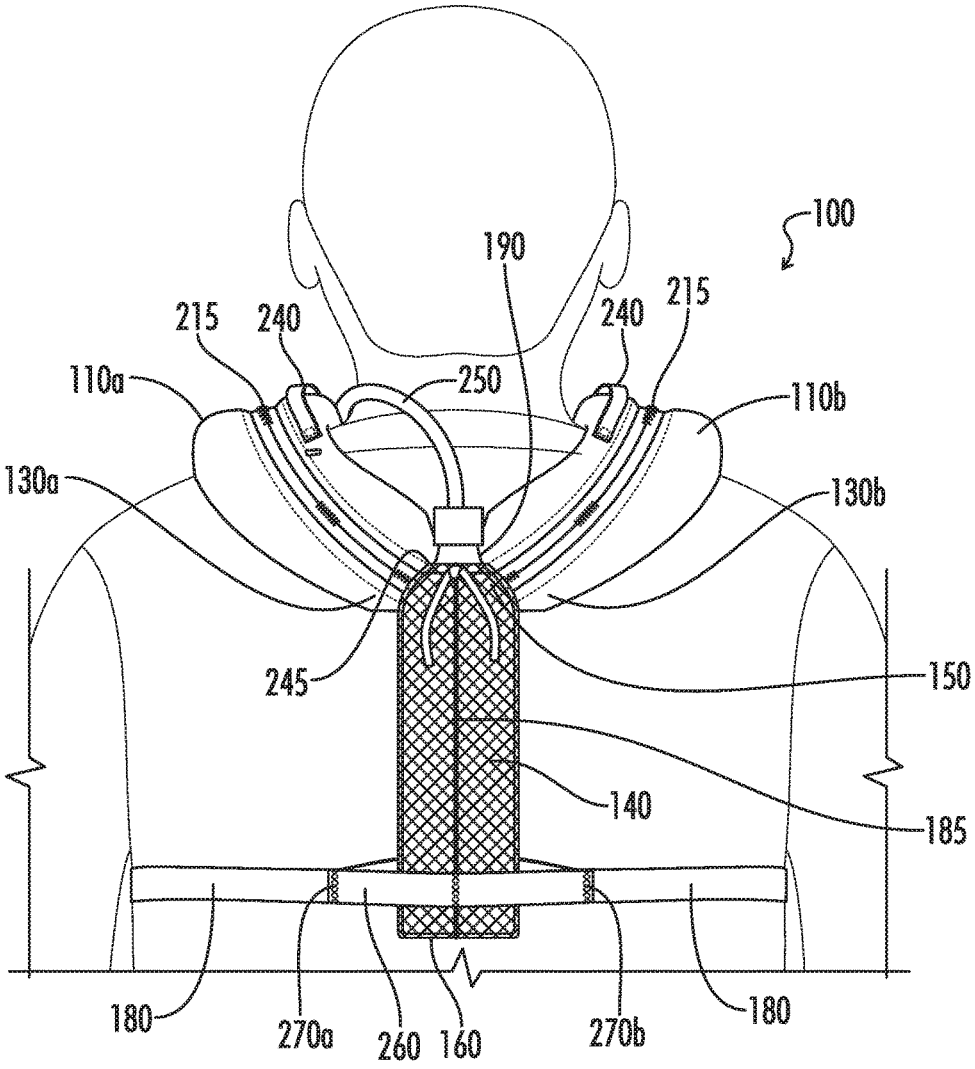
FIG. 2 is a back view of the pack of FIG. 1 when worn by a user.
Figure 3:
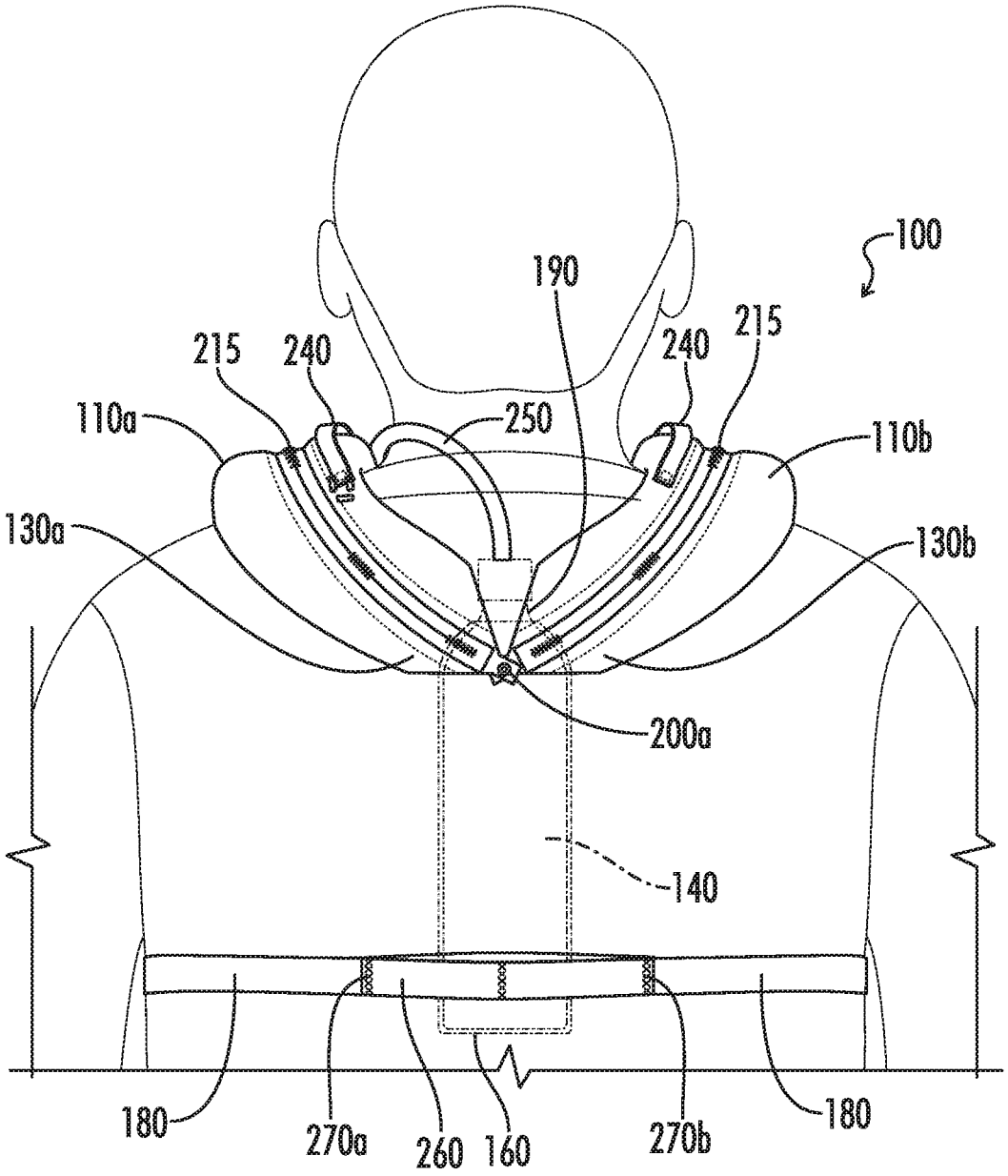
FIG. 3 is a second back view of the pack of FIG. 1 when worn by a user with a portion made transparent.
Figure 4:
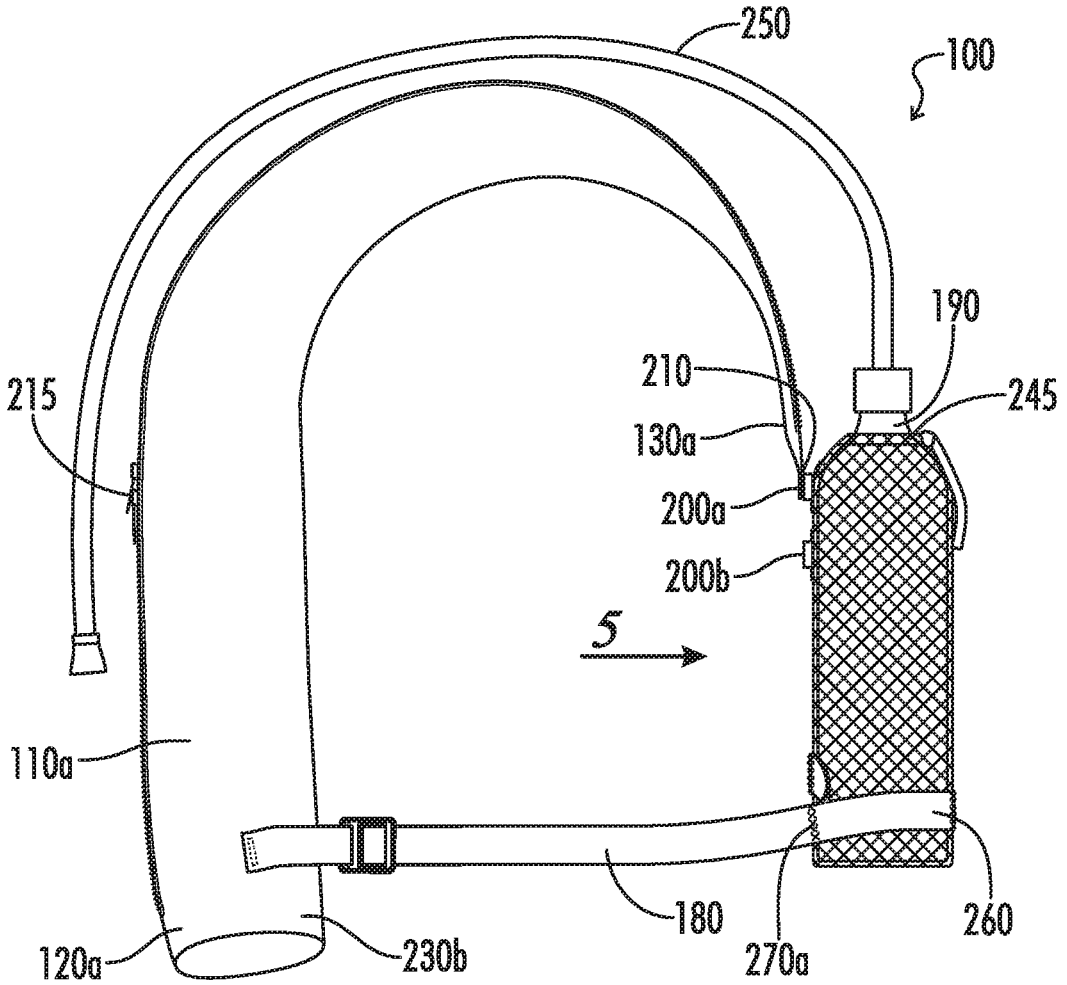
FIG. 4 is a side view of the pack of FIG. 1.
Figure 5:
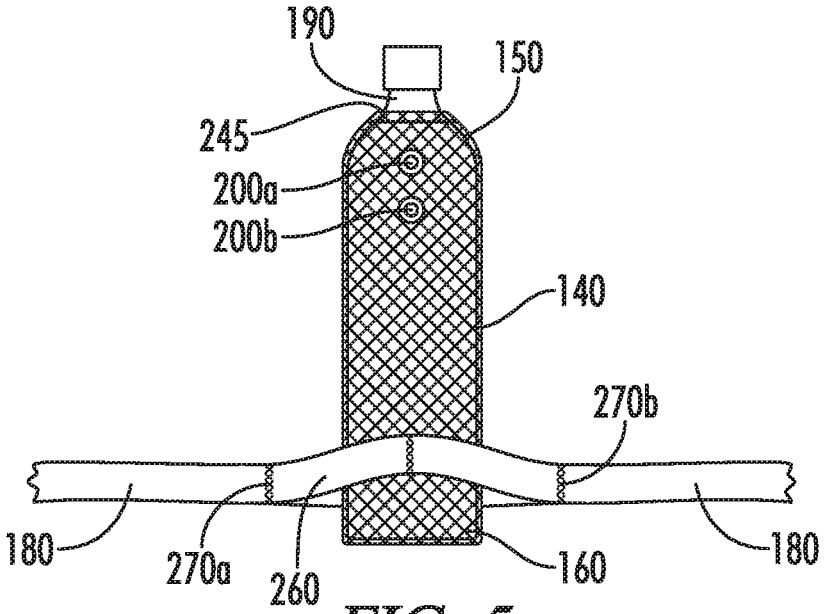
FIG. 5 is a close up view of a stabilizing strap of the pack of FIG. 1 viewed from the direction indicated in FIG. 4.

FIGS. 1-3 provide views of a running pack 100 of the current disclosure when worn by a user. FIG. 4 shows a side view of the pack 100 of FIG. 1, FIG. 5 shows a close up view of a stabilizing strap 260 of the pack of FIG. 1 viewed from the direction indicated in FIG. 4. As shown, the running pack 100 generally comprises a plurality of elongated storage chambers, typically two such chambers 110*a, b*, each chamber having a first end 120*a, b* and a second end 130*a, b*, and a hydration sack 140 for retaining a fluid, the hydration sack having a top end 150 and a bottom end 160.

It will be understood that when referencing an element as being at, for example, a first end, a second end, or a top end or a bottom end, the elements could be adjacent each other, rather than precisely located at the ends.

Figure 6:
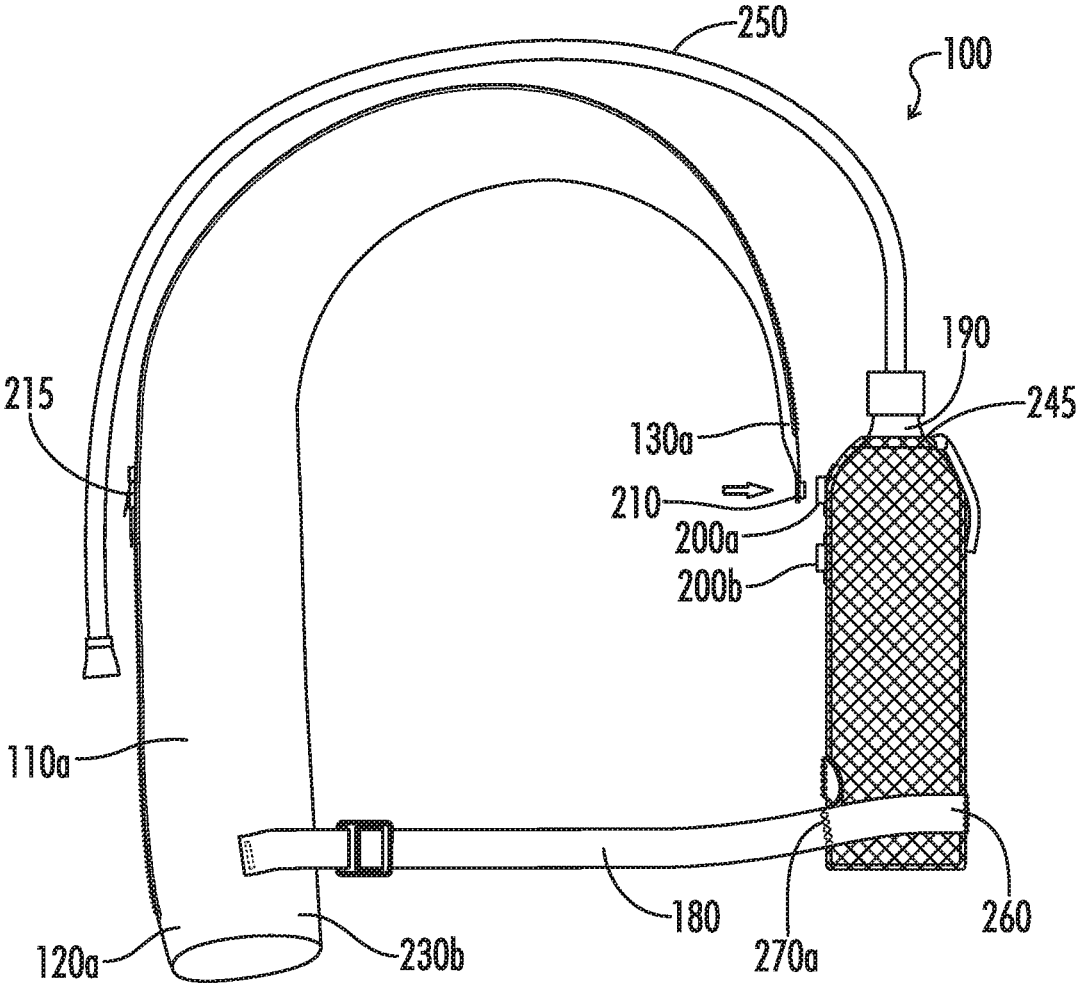
FIG. 6 is the side view of FIG. 4 with a fixation point separated.

FIG. 6 is a side view of the pack 100 with a fixation point 200*a* separated from the second ends 130*a, b* of the elongated storage chambers 110*a, b*.

The running pack further comprises a releasable connector 170 for connecting the first end 120*a* of a first elongated storage chamber 110*a* to the first end 120*b* of a second elongated storage chamber 110*b* of the plurality of elongated storage chambers and a tensioning strap 180 independent of the releasable connector 170 for connecting the first end 120*a* of the first elongated storage chamber 110*a* to the bottom end 160 of the hydration sack 140, and the first end 120*b* of the second elongated storage chamber 110*b* to the bottom end of the hydration sack. When worn, the first ends 120*a, b* of the each of the first and second elongated storage chambers 110*a, b* are located at or near the user's chest, and each of the first and second elongated storage chambers extend over the user's shoulders.

As shown, the second end 130*a* of the first elongated storage chamber 110*a* is connected to the second end 130*b* of the second elongated storage chamber 110*b* and the top end 150 of the hydration sack, and the tensioning strap 180 is connected to the first end 120*a* of the first elongated storage chamber 110*a* at a first end of the tensioning strap, to the first end 120*b* of the second elongated storage chamber 110*b* at a second end of the tensioning strap, and to the bottom end 160 of the hydration sack 140 at a location between the first end and the second end.

When worn by a user, it is noted that the second ends 130*a, b* of the elongated storage chambers 110*a, b* meet high on the user's back or adjacent the nape of the wearer's neck. Accordingly, the hydration sack 140 is retained high on the user's back such that any weight contained therein is elevated. Further, because the second ends 130*a, b* are joined to each other, the corresponding elongated storage chambers 110*a, b* are drawn towards each other so that they pass over the user's shoulder close to the user's neck, rather than further out laterally along the user's shoulders.

It is noted that the embodiment shown provides a hydration sack 140 which is typically configured to hold a fluid container. This may be a largely unstructured mesh container, for example. However, in other embodiments, the hydration sack may comprise or be replaced with a standalone fluid bladder or a fluid container.

It is further noted that the elongated storage chambers 110*a, b* may be provided with gussets in order to support the curvature of the chambers over the user's shoulder, in order to improve their fit.

As shown in FIG. 2, in some embodiments, the hydration sack 140 further comprises a seam 185 extending from the bottom end 160 of the hydration sack to the top end 150 of the hydration sack. The seam 185 may be a reinforced seam and can be webbing thicker than webbing used elsewhere in the hydration sack 140. Further, seam may be doubled webbing, or it may be reinforced with an adhesive or some other reinforcing structure. The seam 185 may be a linear element that provides structure for the hydration pack 140 which may otherwise be unstructured webbing. In some embodiments, the second end 120*b* of the first and second elongated storage chambers 110*a, b* connect to the seam 185 at the top end 150 of the hydration sack 140 and the tensioning strap 180 is connected to the seam at the bottom end 160 of the hydration sack. In other embodiments, such as that shown, the seam 185 is on a back side of the hydration sack 140 and is fixed to the stabilizing strap 260.

In some embodiments, no discrete seam is provided. Accordingly, the tensioning strap 180 and the second ends 120*a, b* may be connected directly to the material of the hydration sack 140. Alternatively, or in addition, in some embodiments, the location at which the second ends 120*a, b* connect to the hydration sack 140 may be reinforced.

Typically, the hydration sack 140 is configured to retain a fluid container 190. Such fluid containers 190 may be available in different sizes. Accordingly, in some embodiments, the hydration sack 140 of the running pack 100 is adjustable to accommodate different size fluid containers 190. Typically, the second ends 130*a, b* of the elongated storage chambers 110*a, b* are connected to each other, and are similarly fixed to the hydration sack 140 at a fixation point 200*a*. This may be by way of a mechanical connector or fastener 210, such as a flanged nut and bolt, a snap, or a button. It is noted that while the elongated storage chambers 110*a, b* are shown and described as connected to each other and fixed to the hydration sack 140 at the fixation point 200*a*, or at one of multiple fixation points 200*a, b*, it is understood that the elongated storage chambers 110*a, b* may be fixed directly to the hydration sack 140, and not to each other, and that the storage chambers 110*a, b* may be connected to the hydration sack 140 by way of an independent piece of material.

In such embodiments, multiple fixation points 200*a, b* may be provided on the hydration sack 140 adjacent the top end 150 of the sack. These fixation points 200*a, b* may be located and arranged vertically along a length of the hydration sack 140, and may both be located on the seam 185. Accordingly, when the second ends 130*a, b* of the elongated storage chambers 110*a, b* are fixed to a first of the fixation points 200*a* by way of the fastener 210, the running pack 100 is set to a first size, and when fixed to a second of the fixation points 200*b*, the running pack is set to a second size, and one of the fixation points 200*a, b* is used at a time selectively. While the first and second sizes accommodate different size fluid containers, such as large and small water bottles, it is noted that, as discussed above, the second ends 130*a, b* remain located high on the user's back when worn, such that the mass of the fluid containers contained within the hydration sack 140 are retained high on the wearer's back. Additionally, a length of webbing can be used to connect the top end 140 of the hydration sack at one or a number of fixation points 200*a, b* to the second end 120*b* of the first and second elongated storage chambers 110*a, b*.

While the fixation points 200*a, b* are discussed as accommodating a fastener, it will be understood that the second ends 130*a, b* of the elongated storage chambers 110*a, b* may be fixed to each other and to the top end 150 of the hydration sack 140 in various ways, including welding, sewing, zipper closure, mechanical fastener, magnetic fastener, hook and loop fastener, tie, strap, stitched structure, taped structure, glue, adhesive, clip, button, or snap-in structures. Other methods of attachment are similarly contemplated.

As shown in FIGS. 1-3, one embodiment of the running pack 100 is shown as worn by a user. The hiking pack 100 is typically worn over the user's shoulders as shown in FIG. 2. The hiking pack 100 of the embodiment of FIG. 1 comprises two elongated storage chambers 110*a, b*, with each elongated storage chamber having two ends 120*a, b*, 130*a, b*, and an interior space between the ends. Each elongated storage chamber 110*a, b* may be any elongated shape or size to accommodate different capacities and needs of the user. Each elongated storage chamber 110*a, b* has an access 215 to allow the user to open and close the storage chamber to store and remove items. The access 215 may comprise one or more opening and closing structures, including one or more zipper closures with one or more zipper pulls 120*a,b*, mechanical fasteners, magnetic fasteners, hook and loop fasteners, ties, straps, stitched structures, taped structures, glued structures, caps, clips, buttons, and snap-in structures. Other access and opening/closing structures are contemplated as well. In the illustrated embodiment, a releasable connector 170 is attached to a first side 220*a, b* of each elongated storage chamber 110*a, b* at a position adjacent to the first end 120*a, b* of the corresponding elongated storage chamber. The releasable connector 170 may comprise one or more structures, including a zipper closure, mechanical fastener, magnetic fastener, hook and loop fastener, tie, strap, stitched structure, taped structure, glued structure, heat sealed or other sealed structure, cap, clip, button, or snap-in structure, or the like. A tensioning strap 180, which is typically adjustable, is attached to a second side 230*a, b* of each elongated storage chamber 110*a, b* and allows a user to vary not only the amount of curvature and therefore fit of the running pack 100 relative to a user while worn or carried, but also the overall diameter of the running pack, i.e. from the front of the pack to the rear of pack, to accommodate different body types.

The tensioning strap 180 may comprise one or more structures, including a zipper closure, mechanical fastener, magnetic fastener, hook and loop fastener, tie, strap, taped structure, glued structure, heat sealed or other sealed structure, cap, clip, button, or snap-in structure. Each storage chamber 110 may comprise one or more straps 240. The straps 140 may be secured to the storage chamber 110 in a variety of ways, but are typically permanently fixed to the structure, which may be by way of stitching or adhesive, for example. The straps 240 may comprise one or more webbing straps to hold or hang the running pack 100, for example, on a tree limb or a hook or to hold or support another part of the running pack 100. The straps 240 may be arranged in loop or may be provided in the form of ladder webbing. In some embodiments, the various straps 240 may take different forms. Various straps 240 may also be used to secure gear, including a food bag(s), cooking gear, sleeping bag, sleeping pad, head cap, balaclava, gloves, compass, flashlight, headlamp, food, matches, knife, sunscreen, sunglasses, whistle, insect repellent, socks, shirts, pants, clothing, keys, toilet paper, bags, hiking poles, ice axe, GPS, radio, ID, field guides, and binoculars. In some embodiments, additional straps may take the form of one or more handles for holding the running pack 100.

Typically, the hydration sack 140 comprises an opening 245 adjacent the top end 150. Accordingly, a fluid tube 250 may be provided extending from the hydration sack 140 or the fluid container by way of the opening 245 in order to make the fluid contained therein accessible by the user. The fluid tube is typically secured to one of the elongated storage chambers 110*a, b* by one or more of the straps 240, webbing, U-shaped flex plastic, or other tie-down methods. The fluid tube 250 may end in a dispensing mechanism 260 which may comprise one or more of a valve, bite valve, cap, lid, or screw. Additionally, an opening in the bottom of the hydration sack 140 can be provided for an inverted fluid container for use with a fluid tube 250 may end in a dispensing mechanism 260 which may comprise one or more of a valve, bite valve, cap, lid, or screw.

The opening 245 may be closed with a sealing mechanism, such as lace that is tied and untied, a cord, zipper closure, mechanical fastener, magnetic fastener, hook and loop fastener, tie, strap, stitched structure, taped structure, glued structure, cap, clip, button, or snap-in structure. The sealing mechanism may be secured with a cord lock, although other sealing structures are contemplated.

In some embodiments, the tensioning strap 180 may be provided with a stabilizing strap 260. Such a stabilizing strap may extend from the tensioning strap 180 at two locations 270*a, b* and may extend around and encircle the hydration sack 140. Accordingly, the stabilizing strap 260 has a length longer than a length of the tensioning strap 180 between the two locations 270*a, b*. In this way, the tensioning strap 180 may lay flat against the user's back while the stabilizing strap 260 extends around the hydration sack 140 and fixes the location of any mass, such as a fluid container contained therein relative to the tensioning strap 180.

In some embodiments, the running pack 100 is a sewn garment and could be adhered or fused materially based on the type of materials used. The running pack 100 may comprise twenty-three pieces: 2 elongated storage chambers 110*a, b,* 2 zippers, 4 zipper sliders, 2 gussets, 2 tension adjusters and related webbing, 2 half buckles and related webbing, 2 front end caps and 2 rear end webbings for connection to a hydration sack 140, 1 carrying strap, and 4 ladder webbings. The hydration sack 140 includes stabilizer webbing for stability and connection to tension adjusters. The top of hydration sack 140 further includes a string or other element enclosed of hydration sack 140 to tie off and secure the fluid container 190 from falling out of hydration sack 140. The structure described provides the elimination of numerous bio-mechanical inefficiencies of earlier backpacks and vest-packs. The front of the pack provides immediate access to the majority of gear essential for the user versus the backpack and the vest-pack. With a single water container located centrally in the rear of the pack, minimal side to side thrusting that wastes user energy is achieved. Located above the hips at the rear of the pack, natural pace speed is achieved. Normal breathing is achieved with a buckle in front connecting the two storage chambers together located just below the pectoral muscles. With the storage chambers located over the trapezoid muscles, the raising and lowering of outer shoulder located storage chambers energy waste is eliminated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A running pack comprising:

a. a plurality of elongated storage chambers, each chamber having a first end and a second end;

b. an hydration sack for retaining a fluid, the hydration sack having a top end and a bottom end;

c. a releasable connector for connecting the first end of a first elongated storage chamber to the first end of a second elongated storage chamber of the plurality of elongated storage chambers;

d. a tensioning strap independent of the releasable connector for connecting the first end of the first elongated storage chamber to the first end of the second elongated storage chamber;

wherein the second end of the first elongated storage chamber is directly connected to the second end of the second elongated storage chamber and the top end of the hydration sack, wherein the tensioning strap is connected to the first end of the first elongated storage chamber at a first end, to the first end of the second elongated storage chamber at a second end, and to the bottom end of the hydration sack at a location between the first end and the second end, and wherein the hydration sack further comprises a seam extending from the bottom end of the hydration sack to the top end of the hydration sack, wherein the second end of the first and second elongated storage chambers connect to the seam at the top end of the hydration sack and the tensioning strap is connected to the seam at the bottom end of the hydration sack.

2. The running pack of claim 1, wherein, when worn by a user, the first ends of each of the first and second elongated storage chambers are located at the user's chest and each of the first and second elongated storage chambers extend over the user's shoulders, and wherein the hydration sack is located at the user's back.

3. The running pack of claim 1, wherein the seam is reinforced and thereby thicker or stiffer than webbing used elsewhere in the hydration sack.

4. The running pack of claim 1, wherein the hydration sack further comprises a plurality of fixation points adjacent the top end, and wherein the second end of the first elongated storage chamber and the second end of the second elongated storage chamber are selectively fixed to one of the plurality of fixation points.

5. The running pack of claim 4, wherein the plurality of fixation points are arranged vertically along a length of the hydration sack, and wherein the running pack is in a first size configuration when the first and second elongated storage chambers are connected to a first of the plurality of fixation points and the running pack is in a second size configuration when the first and second elongated storage chambers are connected to a second of the plurality of fixation points.

6. The running pack of claim 5, wherein the first size is configured for locating a first size of fluid container within the hydration sack and the second size is for locating a second size of fluid container within the hydration sack.

7. The running pack of claim 1, wherein each of the first and second elongated storage chambers each comprise an interior space between the respective first end and second end.

8. The running pack of claim 1 further comprising at least one stabilizing strap extending from the tensioning strap at two locations and encircling the hydration sack, wherein the stabilizing strap has a length longer than a length of the tensioning strap between the two locations.

9. The running pack of claim 1 further comprising at least one stabilizing strap extending from the tensioning strap at two locations and secured to sides of the hydration sack and to the tensioning strap.

10. The running pack of claim 1, wherein the hydration sack comprises an opening adjacent the top end or an opening adjacent the bottom end.

11. The running pack of claim 10, wherein the hydration sack holds a fluid container.

12. The running pack of claim 11, wherein the fluid container is attached to a fluid tube.

13. The running pack of claim 12, wherein the fluid tube is secured to one of the plurality of elongated storage chambers by a securing mechanism.

14. The running pack of claim 11, wherein the fluid container is a fluid bladder.

* * * * *